United States Patent [19]

Jennings, Jr. et al.

[11] Patent Number: 4,860,830

[45] Date of Patent: Aug. 29, 1989

[54] METHOD OF CLEANING A HORIZONTAL WELLBORE

[75] Inventors: Alfred R. Jennings, Jr., Plano; John K. Shucart, Dallas, both of Tex.

[73] Assignee: Mobil Oil Corporation, New York, N.Y.

[21] Appl. No.: 229,050

[22] Filed: Aug. 5, 1988

[51] Int. Cl.[4] ..... E21B 37/00

[52] U.S. Cl. ..... 166/312; 166/50

[58] Field of Search ..... 166/50, 291, 304, 312

[56] References Cited

U.S. PATENT DOCUMENTS

| | | | |
|---|---|---|---|
| Re. 30,484 | 1/1981 | Broaddus et al. | 166/307 |
| 1,809,546 | 6/1931 | Bowman | 166/312 |
| 2,324,254 | 7/1943 | Bertness et al. | 166/312 |
| 3,312,284 | 4/1967 | D'Audiffret et al. | 166/50 X |
| 3,945,436 | 3/1976 | Nebolsine | 166/312 X |
| 4,046,197 | 9/1977 | Gruesbeck, Jr. et al. | 166/312 X |
| 4,137,971 | 2/1979 | Shaughnessy et al. | 166/312 X |
| 4,186,803 | 2/1980 | Mondshine | 166/312 X |
| 4,423,781 | 1/1984 | Thomas | 166/312 |
| 4,532,994 | 8/1985 | Toma et al. | 166/50 X |
| 4,671,357 | 6/1987 | Binder, Jr. | 166/291 |

*Primary Examiner*—George A. Suchfield
*Attorney, Agent, or Firm*—Alexander J. McKillop; Charles J. Speciale; Charles A. Malone

[57] ABSTRACT

A method for cleaning a horizontal wellbore where a first fluid have a known specific gravity is introduced into said wellbore. Thereafter, a second fluid having a specific gravity less than said first fluid is introduced into said wellbore. Said second fluid overrides the first fluid and contacts contaminants in the top of said wellbore while the second fluid contacts contaminants on the bottom of said wellbore. Both fluids and contaminants are removed thereby cleaning said wellbore.

18 Claims, 1 Drawing Sheet

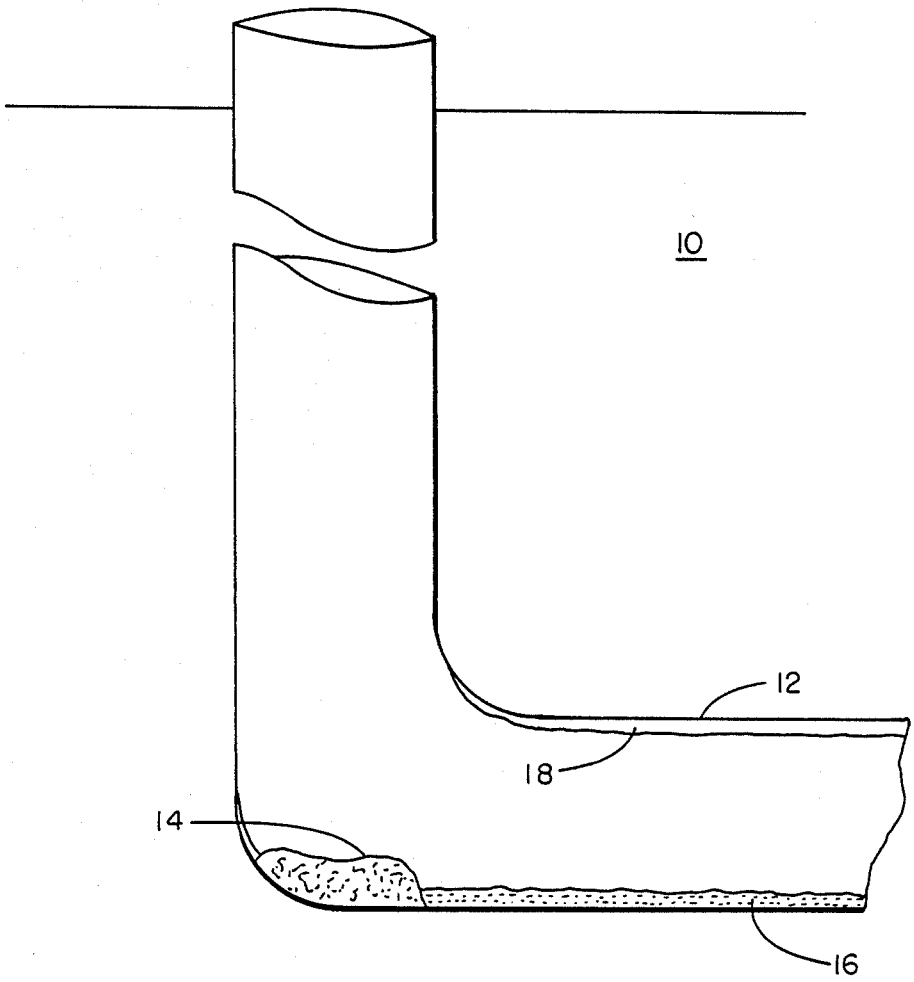
10
12
18
14
16

METHOD OF CLEANING A HORIZONTAL WELLBORE

FIELD OF THE INVENTION

This invention is directed to a method for cleaning underground tubular goods used in the production of hydrocarbonaceous fluids from a formation. More particularly, it is directed to the cleaning of a horizontal wellbore.

BACKGROUND OF THE INVENTION

With advances in drilling technology it is currently possible to drill horizontal wellbores deep into hydrocarbon producing reservoirs. There are many advantages to a horizontal well completion including extending contact with a producing formation thereby facilitating drainage and production of the reservoir.

Although horizontal wellbores allow more contact with the producing formation, one encounters some difficulties in well completions associated with horizontal wellbores not commonly dealt with in vertical wells. One area of concern in well completions is the inability to effectively clean out the horizontal section so production casing can be run into the well and cemented. Another area of concern is the inability to effectively clean a cased wellbore in conjunction with completion or workover operations. Present methods leave drilled solids, e.g., formation fines and cuttings, in the hole which contaminates cement and interferes with bonding and strength of cement as the well is completed.

The kind of contaminant remaining in a wellbore depends of course on the operation previously conducted therein. Composition of fluids used in previous operations can vary. Drilling muds, completion fluids, and workover fluids have varying compositions.

Drilling mud are those fluids used in rotary drilling to cool and lubricate the bit, lift cuttings from the borehole, and to control borehole pressure. Drilling muds should have a viscosity, density, and a fluid retention level suitable for the particular drilling application and the formation being drilled. For instance, a drilling mud generally must be sufficiently dense to control the pressure of the well and simultaneously sufficiently plastic to carry and lift cuttings from the well.

Completion fluids are those fluids used after drilling is complete and during the steps of completion of the well. Completion can include cementing the casing, perforating the casing, setting the tubing and pump, etc.

Workover fluids are those fluids used during remedial work in the well. This can include removing tubing, replacing a pump, cleaning out sand or other deposits, reperforating, etc. Workover also broadly includes steps used in preparing an existing well for secondary or tertiary oil recovery such as polymer additions, micellar flooding, steam injection, etc., or for well stimulation such as acidizing, fracturing the formation, etc.

If problems involving the composition of the various fluids used in a wellbore weren't enough, there is the added problem of air pockets within a horizontal wellbore which prevent portions of a wellbore from being contacted with a cleaning fluid. Therefore, what is needed is a method for cleaning a horizontal wellbore which is effective in removing various contaminants and which can also contact previously precluded portions of said wellbore.

SUMMARY

This invention is directed to a method for effectively cleaning a horizontal wellbore. In performing this invention, a high density fluid is used to wash said wellbore. Once pumping of the high density fluid into the horizontal wellbore has ceased, the wellbore is shut in which allows the high density fluid to equilibrate. During equilibration, the high density fluid contacts those areas where an air pocket does not exist. After equilibration, a fluid having a density lower than the high density fluid is circulated into said horizontal wellbore.

The lower density fluid rides along the top of the higher density fluid initially and contacts contaminants on the upper portion of the horizontal wellbore. Pumping is again ceased and the lower density fluid is allowed to equilibrate. The lower density fluid flows on top of the high density fluid and displaces air pockets on the top side of the horizontal wellbore and provides flushing of that area. Any contaminants in the area of a displaced air pocket is contacted with the lower density fluid. After allowing sufficient time for the fluids to equilibrate, both fluids, along with any contaminants are removed from the wellbore. For the final stage of the clean-out, alternate volumes of low density and high density fluids could be used to complete the clean-out operation.

It is therefore an object of this invention to provide a method for more effectively cleaning a horizontal wellbore.

It is another object of this invention to provide a method for removing contaminants in a horizontal wellbore by the use of suitable solvents.

It is yet another object of this invention to contact previously inaccessible portions of a horizontal wellbore with fluids for the removal of contaminants.

BRIEF DESCRIPTION OF THE DRAWING

The drawing represents a sectional view of a horizontal wellbore where solid contaminants, water, and hydrocarbonaceous matter are depicted.

DESCRIPTION OF THE PREFERRED EMBODIMENTS

In the practice of this invention, referring to the drawing, a horizontal wellbore 12 penetrates formation 10. Into wellbore 12, a high density fluid should have a specific gravity of from about 1.0 to about 1.4 at room temperature. Room temperature as defined herein means a temperature of from about 15° C. to about 20° C. Preferred high density fluids include aqueous sodium chloride solutions, aqueous calcium chloride solutions, and aqueous potassium chloride solutions.

Upon entry into horizontal wellbore 12, the high density fluid agitates and mixes with the solid contaminants 14 and water 16 on the bottom of said wellbore. These solid contaminants include drilling mud, metal cuttings, formation fines, and other foreign solid matter. The high density fluid also mixes with water 16 which may have separated from hydrocarbonaceous fluids when said fluids were being pumped to the surface through said wellbore. As the high density fluid mixes with the solid contaminants, these contaminants tend to remain suspended because of the fluid's high density. After a sufficient amount of high density fluid has been introduced into horizontal wellbore 12, pumping is ceased and the high density fluid is allowed to equilibrate. Equilibration will generally take from about 0.25 to about 0.50 hours.

After the high density fluid has been allowed sufficient time to equilibrate, a fluid having a density less than said high density fluid is pumped or otherwise introduced into wellbore 12. The lower density fluid overrides the high density fluid while the high density fluid remains in contact with the lower portion of wellbore 12. Upon overriding the high density fluid, said lower density contacts the top portion of wellbore 12 and removes hydrocarbonaceous matter from said top portion. While overriding the high density fluid, the lower density fluid enters into portions of the horizontal wellbore containing air pockets. Here it displaces said air pockets and contacts hydrocarbonaceous matter 18 on the top side of wellbore 12. Said low density fluid is pumped into wellbore 12 in an amount and for a time sufficient to remove air pockets and mix with hydrocarbonaceous matter 18. Thereafter, pumping is ceased and the low density fluid is allowed sufficient time to equilibrate. After the low density fluid has been allowed sufficient time to equilibrate, additional wellbore volumes of low density fluid are pumped or introduced into wellbore 12.

Once sufficient wellbore volumes of low density fluid have been introduced into wellbore 12, it and the high density fluid are removed from wellbore 12. Prior to cementing or otherwise completing wellbore 12, it is flushed with a high density brine solution.

Low density solutions which can be used herein include brine, diesel fuel, kerosene, or xylene and mixtures or compounds having similar characteristics, and mixtures thereof. When brine is used herein it should have a density of about 1.0 to 1.2. Brine solutions which can be utilized herein include aqueous sodium chloride, aqueous calcium chloride, aqueous zinc chloride, and aqueous potassium chloride. These solutions are discussed in U.S. Pat. No. Re. 30,484 which issued to Broaddus et al. on Jan. 20, 1981. This patent is hereby incorporated by reference herein. This patent also discloses the use of fluids with different densities during fracture acidizing. Other brine solutions which can be used include aqueous sodium bromide, aqueous calcium bromide, aqueous potassium bromide, and zinc bromide.

In accordance with the method of the present invention, the densities of the high and low density fluids are controlled to cause separation and segregation of the fluids into an upper and lower zone of the horizontal wellbore.

In order to achieve separation and segregation between the fluids used, the densities thereof must be such that a difference in the specific gravities of the fluids of at least about 0.025 exists at the conditions existing in the wellbore to be treated. Preferably, fluids are utilized having a specific gravity difference of about 0.10 at the conditions in the wellbore which creates a pronounced vertical movement of one fluid with respect to the other. In treatments where an extreme overriding of one fluid with respect to another is required, a specific gravity difference of 0.20 between the fluids is preferred.

High viscosity fluids tend to move through a wellbore as a mass with less tendency to be affected by differing densities than low viscosity fluids. Low viscosity fluids on the other hand readily override and underride fluids of differing density. Therefore, high and low density fluids having apparent viscosities of less than about 100 cps at the temperatures existing in the wellbore into which they are to be introduced are generally preferred for use in accordance with this invention. However, higher viscosity high and low density fluids can be used if the circumstances dictate and overriding can be accentuated by utilizing fluids of differing viscosity. More specifically, the segregation and separation of the high and low density fluids can be enhanced by using a high density fluid having a higher viscosity than the low density fluid. Preferably when high density and low density fluids of different viscosity are used, the high density fluid viscosity is in the range of from about 5 to about 80 times the viscosity of the low density fluid.

Listed below are some minimum required high and low density solutions which can be used herein.

TABLE I

Examples of High Density Fluids

| Fluid | Concentration By Weight (%) | Specific Gravity @ 20° C. | Density Pounds Per Gallon @ 20° C. |
|---|---|---|---|
| NaCl | 2 | 1.0144 | 8.15 |
| NaCl | 4 | 1.0292 | 8.57 |
| NaCl | 8 | 1.0590 | 8.82 |
| NaCl | 12 | 1.0894 | 9.07 |
| NaCl | 26 (sat.) | 1.2025 | 10.02 |
| KCl | 2 | 1.0110 | 8.42 |
| KCl | 4 | 1.0239 | 8.53 |
| KCl | 8 | 1.0500 | 8.75 |
| KCl | 12 | 1.0768 | 8.97 |
| KCl | 24 (sat.) | 1.1623 | 9.68 |
| $CaCl_2$ | 2 | 1.0148 | 8.45 |
| $CaCl_2$ | 4 | 1.0316 | 8.59 |
| $CaCl_2$ | 8 | 1.0659 | 8.88 |
| $CaCl_2$ | 12 | 1.1015 | 9.18 |
| $CaCl_2$ | 40 (sat.) | 1.3957 | 11.63 |
| $ZnCl_2$ | 2 | 1.0167 | 8.47 |
| $ZnCl_2$ | 4 | 1.0350 | 8.62 |
| $ZnCl_2$ | 8 | 1.0715 | 8.93 |
| $ZnCl_2$ | 12 | 1.1085 | 9.23 |
| $ZnCl_2$ | 70 (sat.) | 1.9620 | 16.34 |

TABLE II

Low Density Fluids

| Fluid | Specific Gravity @ 20° C. | Density Pounds Per Gallon @ 20° C. |
|---|---|---|
| Diesel Oil | 0.85 | 7.08 |
| Kerosene | 0.82 | 6.85 |
| Xylene | 0.87 | 7.25 |
| Toluene | 0.87 | 7.25 |

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for cleaning a horizontal wellbore comprising:

(a) introducing into said wellbore a first fluid having a known specific gravity;

(b) ceasing the introduction of said first fluid into the wellbore and allowing said first fluid to equilibrate;

(c) introducing into said wellbore a second fluid having a specific gravity of at least 0.1 less than the specific gravity of said first fluid whereby said second fluid overrides said first fluid so as to contact contaminants in the top section of said wellbore while said first fluid contacts contaminants in the bottom section of said wellbore;

(d) ceasing the introduction of said second fluid into the wellbore and allowing both fluids to equilibrate; and (e) removing both fluids containing said contaminants from said wellbore thereby cleaning said wellbore.

2. The method as recited in claim 1 where said first fluid is selected from a member of the group consisting of aqueous potassium chloride, sodium chloride, calcium chloride, zinc chloride, potassium bromide, sodium bromide, calcium bromide, and zinc bromide.

3. The method as recited in claim 1 where said second fluid is selected from a member of the group consisting of diesel fuel, kerosene, xylene, aqueous potassium chloride, sodium chloride, and calcium chloride.

4. The method as recited in claim 1 where after step (d) additional wellbore volumes of said fluid are introduced into said wellbore and removed.

5. The method as recited in claim 1 where the apparent viscosities of the first and second fluids in said wellbore are less than about 100 cps at the temperature existing in said wellbore.

6. The method as recited in claim 1 wherein said second fluid has a specific gravity range of about 0.50 to about 1.20 at room temperature.

7. The method as recited in claim 1 where the first fluid has a viscosity of about 5 to about 80 times greater than the viscosity of the second fluid.

8. The method as recited in claim 1 where the first fluid has a specific gravity of about 1.0 to about 1.4 at room temperature.

9. The method as recited in claim 1 where in step (a) said first fluid mixes with solid contaminants and said contaminants remain suspended in the first fluid.

10. A method for cleaning a horizontal wellbore comprising:

(a) introducing into said wellbore a first fluid having a known specific gravity;

(b) ceasing the introduction of said first fluid into the wellbore and allowing said first fluid to equilibrate;

(c) introducing into said wellbore a second fluid having a specific gravity of about 0.025 to about 0.2 less than the specific gravity of said first fluid whereby said second fluid overrides said first fluid so as to contact contaminants in the top section of said wellbore while said first fluid contacts contaminants in the bottom section of said wellbore;

(d) ceasing the introduction of said second fluid into the wellbore and allowing both fluids to equilibrate; and (e) removing both fluids containing said contaminants from said wellbore thereby cleaning said wellbore.

11. The method as recited in claim 10 where said first fluid is selected from a member of the group consisting of aqueous potassium chloride, sodium chloride, calcium chloride, zinc chloride, potassium bromide, sodium bromide, calcium bromide, and zinc bromide.

12. The method as recited in claim 10 where said second fluid is selected from a member of the group consisting of diesel fuel, kerosene, xylene, aqueous potassium chloride, sodium chloride, and calcium chloride.

13. The method as recited in claim 10 where after step (d) additional wellbore volumes of said fluid are introduced to said wellbore and removed.

14. The method as recited in claim 10 where the apparent viscosities of the first and second fluids in said wellbore are less than about 100 cps at the temperature existing in said wellbore.

15. The method as recited in claim 10 wherein said second fluid has a specific gravity range of about 0.50 to about 1.20 at room temperature.

16. The method as recited in claim 10 where the first fluid has a viscosity of about 5 to about 80 times greater than the viscosity of the second fluid.

17. The method as recited in claim 10 where the first fluid has a specific gravity of about 1.0 to about 1.4 at room temperature.

18. The method as recited in claim 10 where in step (a) said first fluid mixes with solid contaminants and said contaminants remain suspended in the first fluid.

* * * * *

UNITED STATES PATENT AND TRADEMARK OFFICE

CERTIFICATE OF CORRECTION

PATENT NO. : 4,860,830

DATED : August 29, 1989

INVENTOR(S) : Alfred R. Jennings, Jr. et al.

It is certified that error appears in the above-identified patent and that said Letters Patent is hereby corrected as shown below:

Column 1, line 38, "mud" should read --muds--.

Column 2, line 48, after "fluid" insert --is pumped or otherwise introduced. The high density fluid--

Column 4, Table 1, 1st line under heading; "8.15" should read --8.45--.

Column 4, line 46 (Table 2); "6.85" should read --6.83--.

Signed and Sealed this

Twenty-fifth Day of December, 1990

*Attest:*

HARRY F. MANBECK, JR.

*Attesting Officer*

*Commissioner of Patents and Trademarks*